US005750071A

United States Patent [19]

Fiorino et al.

[11] Patent Number: 5,750,071

[45] Date of Patent: May 12, 1998

[54] CORROSION PROTECTION EMPLOYING ALTERNATING VOLTAGE

[75] Inventors: Mary E. Fiorino, Bridgewater; Robert P. Frankenthal; James D. Sinclair, both of Summit, all of N.J.

[73] Assignee: Lucent Technologies Inc., Murray Hill, N.J.

[21] Appl. No.: 488,666

[22] Filed: Jun. 8, 1995

[51] Int. Cl.[6] ..... C23F 11/00

[52] U.S. Cl. ..... 422/7; 204/196; 205/724; 205/736; 422/1; 422/40

[58] Field of Search ..... 422/7, 1, 40; 204/196; 205/724, 736

[56] References Cited

U.S. PATENT DOCUMENTS

| | | | |
|---|---|---|---|
| 3,655,905 | 4/1972 | Ray | 204/196 |
| 4,869,016 | 9/1989 | Diprose et al. | 43/124 |
| 5,172,007 | 12/1992 | Lumetta et al. | 307/10.1 |
| 5,346,598 | 9/1994 | Riffe et al. | 204/196 |
| 5,352,342 | 10/1994 | Riffe | 204/196 |

*Primary Examiner*—Robert J. Warden

*Assistant Examiner*—Krisanne M. Thornton

[57] ABSTRACT

A method of protecting metals from corrosion by applying an alternating voltage to them, thereby reversing the metal's polarity with respect to its surroundings. Particular applications are for metals which are buried in soil or are exposed to an electrolyte. Amphoteric metals Steels, which are subject to hydrogen embrittlement when made cathodic, are also protected by polarity reversal.

23 Claims, 2 Drawing Sheets

CORROSION PROTECTION EMPLOYING ALTERNATING VOLTAGE

BACKGROUND OF THE INVENTION

1. Field of the Invention

This invention relates to the corrosion protection of metals by the application of an alternating voltage to them.

2. Description of Related Art

Corrosion is a destructive electrochemical process which continues to be enormously costly and one which sometimes threatens human safety. The exposure of metals to air, water, or soil provides the opportunity for chemicals to ionize to form an electrolyte which is the pathway for the corrosion process. The process has been described as occurring in two places, each of which is commonly referred to as a half-cell. Certain areas of the metal may serve as an anode where oxidation, an increase in valence state, takes place. Typically, a metal atom is transformed into an ion with positive valence together with the release of one or more electrons. Other areas of the same metal may serve as a cathode where electrons are absorbed, a reduction, or decrease in valence state, to create atoms of hydrogen, chlorine, sulfur, or hydroxide ions, depending upon the reacting species. The reacting species and the reaction products are transported to and from the anode and cathode areas under the influence of electric fields, concentration gradients, and/or other means of mass transport produced by the reaction.

The driving force for the electrochemical corrosion reaction is the overall lowering of free energy of the reacting species from the reaction products, which translates into an electromotive force, commonly called a voltage, for each half-cell of the reaction. The initial rate of this reaction is controlled by an electron transfer reaction which increases exponentially as the voltage between the anode and cathode exceeds a certain threshold. A steady-state rate may be established thereafter which is limited by the mass transport of reacting species or products. This limiting rate may be controlled by a host of factors which complicate the prediction and control of corrosion.

Briefly stated, the factors affecting the corrosion rate are: (1) the corrosion properties of the metal or metals involved, which includes the quality of natural oxides or passivation layers which form naturally or by intent upon their surfaces; (2) lattice strains or surface impurities on the metal which cause localized voltage differences; (3) the type and concentration of each reacting species in the electrolyte which is in contact with the surface of the metal; (4) the rate of mass transport to and away from the anode and cathode; (5) the area ratio of the anode to the cathode; (6) the application of electric fields which may be purposeful or accidental.

Corrosion protection seeks to limit these factors. Paints, finishes, and some corrosion inhibitors seek to exclude the electrolyte from the metal; other corrosion inhibitors seek to re-establish protective oxide layers if they become penetrated by harmful ions, and biasing schemes protect some metals by making them the cathode, either by applying a voltage or by connecting them to a sacrificial anode such as magnesium or zinc, which are oxidized more easily. Ferrous alloys may also form a passivating oxide under anodic protection.

So cathodic protection is well known for some metals, but not all. Other metals are amphoteric, that is to say they readily corrode in acid or base, and can corrode under cathodic bias which forms a base due to the electrolysis of water. These metals include aluminum, tin, lead , zinc and chromium. The first three are very important to the transmission of electrical power and communications signals. High strength steels are also subject to an effect called hydrogen embrittlement, so making them the cathode where hydrogen atoms are liberated substitutes one evil for another.

Accordingly, there is a continuing need to protect metals from corrosion, particularly amphoteric metals and high strength steels. These materials are used in foundations, pipelines for steam, oil, and gas; power distribution, in electronic and communications equipment and cables. Any of these may be exposed to contaminants in air, water, or soil, or to stray fields from power transmission cables.

SUMMARY OF THE INVENTION

The present invention relates to the application of an alternating voltage to the metal to be protected from corrosion so that the polarity of the metal is continuously reversed with respect to its surroundings.

Communications cables sometimes use the outer metal covering to transmit or return power. To limit corrosion, the power may be an alternating voltage with a rectangular, sinusoidal, or triangular waveform.

Where the metal already resides at a voltage different from its surroundings, an opposing constant bias may be applied, with an alternating voltage superimposed upon it.

An advantage of the invention is that metals which are designed to carry power, such as the outer conductor or shield of coaxial cables, may be protected from corrosion by the periodic reversal of their polarity.

Another advantage is the ability to protect metals which are subject to cathodic corrosion by periodically reversing their polarity.

A further advantage is the ability to protect metals which are subject to hydrogen embrittlement, such as very high strength steels or metals which have been severely cold worked, from hydrogen embrittlement during cathodic protection by periodically reversing their polarity These and other features and advantages of the invention will be better understood with consideration of the following detailed description of the preferred embodiments taken in conjunction with the accompanying drawings.

DETAILED DESCRIPTION OF THE PREFERRED EMBODIMENTS

Figure 1:
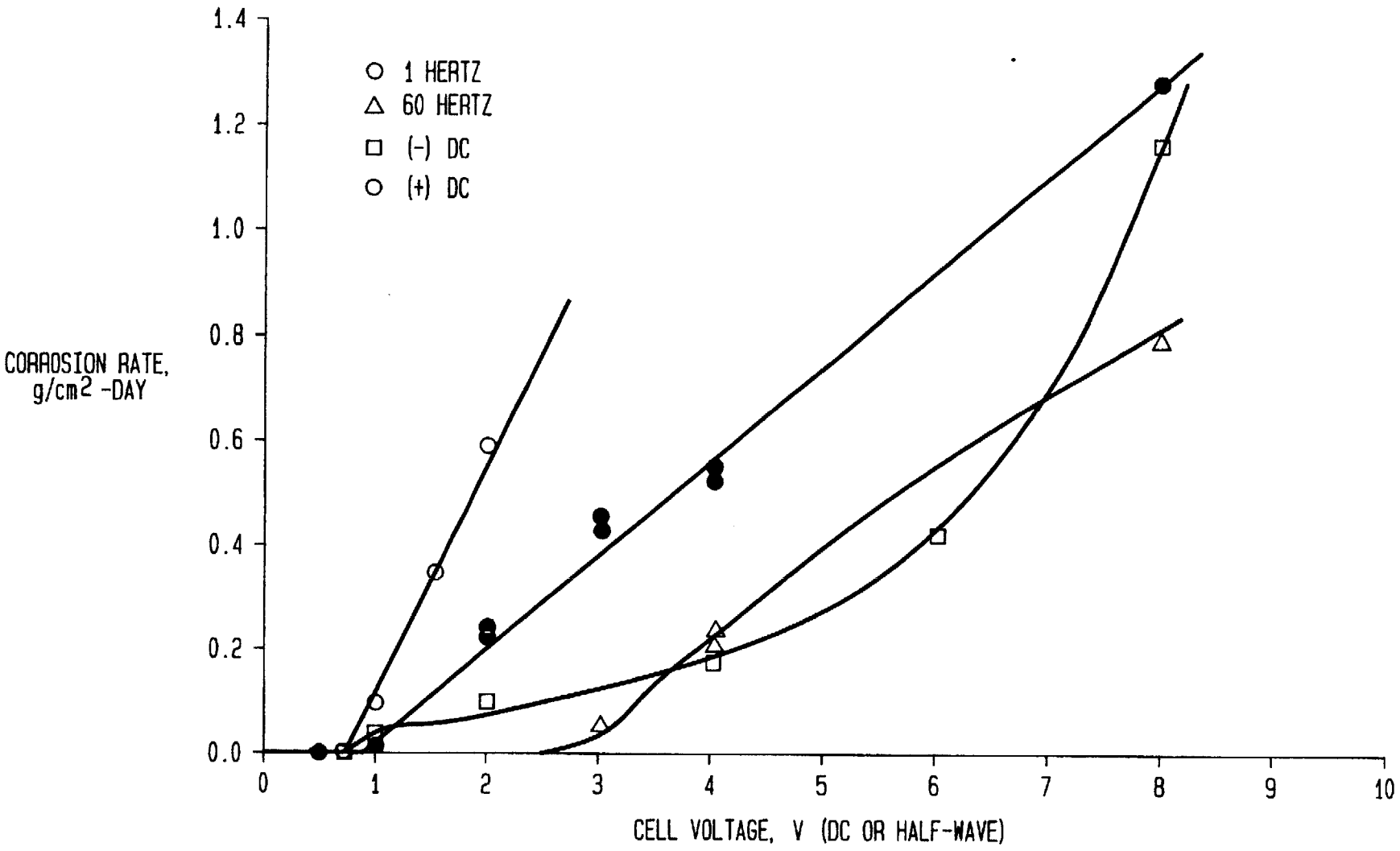
FIG. 1 shows the rate of corrosion versus voltage for aluminum in 25 grams NaCl/1000 grams water solution for various polarizations and frequencies.

The cathodic protection of some metals is well known. The necessary protection may be provided by attaching a sacrificial, less noble metal in contact with the metal to be protected, or by impressing a current between the metal and its surroundings. It is most often used to protect ferrous metals which are buried in the earth or are immersed in water, such as, foundations, piers, pipelines, and ships. Cathodic protection is often used in combination with some form of protective coating to reduce the required current.

Cathodic protection of amphoteric metals such as aluminum, tin, lead, zinc, and chromium is ineffective because they can corrode in the alkaline solution produced at the cathode. Certain alloys are also subject to hydrogen embrittlement. High strength steels are particularly vulnerable. Ferritic and martensitic steels are affected in corrosive sulfide environments, and austenitic steels which have been cold worked are also susceptible. A cold worked lattice can hold many times the solubility limit of hydrogen, which may collect at dislocation sites or the tip of a crack to inhibit plastic deformation or weaken the lattice, respectively. In these cases, conventional cathodic protection is unsuitable and alternating voltage between the metal and its environment is beneficial.

When a metal is exposed to an electrolyte, such as an aqueous solution or a moist soil containing soluble ionic species, with a sufficiently high voltage applied across the metal/electrolyte interface, three processes occur sequentially. First, a layer of charge is produced on the metal surface and a complimentary layer of charge of opposite sign is formed in the adjacent electrolyte. The time to establish this double layer of charge, which is equivalent to a capacitor, is typically tens of microseconds. The capacitance ranges from 10 microfarads/cm$^2$ to several thousand microfarads/cm$^2$, depending upon the metal, electrolyte, and the voltage between them. Where the polarity of the voltage alternates, the charging is usually complete in a few percent of the cycle time for frequencies below 1000 Hz.

The second step, electron transfer, of the corrosion process is the oxidation of the metal at the anode and a reduction reaction at the cathode. These reactions form corrosion products which may be solid, soluble, or which escape as a gas. Electrons liberated at the anode are absorbed by the reaction at the cathode. Initially, the rate of these reactions increases exponentially with increasing voltage, when the applied voltage exceeds a threshold voltage required for the onset of corrosion. This may be expressed by $$i=Ae^{B(V-V_t)}$$

where the current i corresponds to the rate of corrosion, V is the applied voltage, $V_t$ is a threshold voltage depending upon the metal, electrolyte, polarity and frequency of the applied voltage, and A and B are constants.

The third step in the corrosion process is a rate limiting step which prevents the further exponential increase in corrosion rate with increasing voltage. The reacting species in the electrolyte and reaction products must be transported to and from the metal surface. This may occur under the influence of an electric field, or due to a concentration gradient, or other sources of flow or stirring in the electrolyte. Corrosion products that form on and adhere to the metal surface may hinder the rate at which reactants like oxygen can diffuse to the surface. The time at which the change from electron transfer control, step 2, to mass transport control, step 3, takes place is dependent upon the nature of the electrochemical reactions, the applied voltage, the electrolyte and its concentration, and the geometry of the corroding system.

The influence of the alternating voltage depends upon the metal, its environment, the amplitude and frequency of the voltage and the presence of a constant bias. Of these, the frequency of the applied voltage is critical in determining the extent of corrosion. The rates of the electron transfer and mass transport reactions may be time dependent. When the frequency is low, these reactions conform to the changing voltage and during the anodic half-cycle there is sufficient time to destroy passivating oxides and for the rate of metal dissolution to reach steady state. At high frequencies, the reactions can not follow the changing voltage and passivating films tend to remain intact. Therefore, corrosion rates diminish as the frequency is increased. During the positive half-cycle, the rate of metal dissolution is likely to increase as the voltage increases.

During the negative half-cycle, a passivating film which forms on some metals, for example, tin, can be reduced at low frequencies whereas the metal remains protected at high frequencies. The adherent oxide film on aluminum can be dissolved in the basic solution formed by the reduction of water during the negative half-cycle. Oxide dissolution is followed by the corrosion of the underlying metal. As the frequency increases, the solution cannot become sufficiently basic for the oxide to dissolve and for corrosion to occur. The oxides of tin, lead, and chromium are also soluble in base. Copper, iron, nickel, and ferrous alloys usually do not corrode when subject to negative bias.

Referring now to FIG. 1, there is shown a graph relating the rate of corrosion, given as grams/cm$^2$-day, versus voltage, where the voltage is positive, negative, or an alternating square wave at 1 Hz or 60 Hz. For constant bias, the positive polarity clearly is more destructive than the negative. For alternating bias, the data at 1 Hz show that the corrosion rate is less than that of positive bias, as expected. At 60 Hz, not only is the rate reduced further, but the onset of corrosion, given by the threshold voltage on the abscissa is raised to 2.6 volts. The threshold voltages are summarized in the following table which demonstrates the beneficial effects of increasing frequency.

Corrosion of Aluminum in 25 gm NaCl Added to 1 Liter Water

| Bias | $V_{threshold}$ (volts) |
|---|---|
| Constant Positive | 0.7 |
| Constant Negative | 0.7 |
| 1 Hz | 0.9 (half wave) |
| 60 Hz | 2.6 (half wave) |

Figure 2:
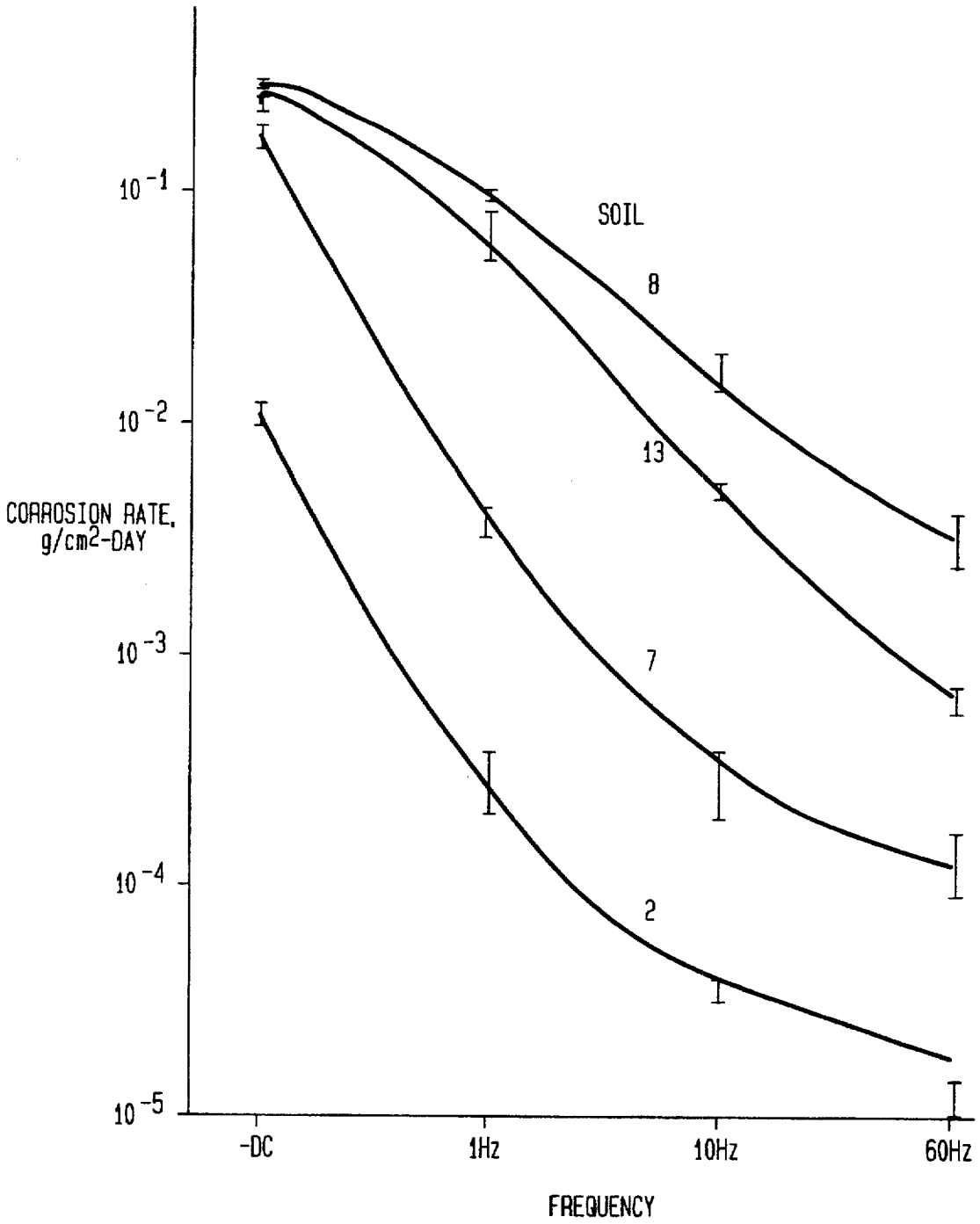
FIG. 2 shows the rate of corrosion versus frequency for aluminum in various soils at −2 volts DC and 2 volts half-wave at different frequencies.

Referring now to FIG. 2, the corrosion rate of aluminum, given in gm/cm$^2$-day is shown versus frequency for various soils. The data were taken for negative bias of 2 volts and for 2 volt half-wave alternating square wave voltage for various frequencies.

Therefore, a metal subject to an applied or induced voltage may be protected from or made less susceptible to corrosion by applying an alternating voltage to it with respect to its surroundings. The rate of corrosion is diminished as the frequency of the alternating voltage is increased. The waveform of the alternating voltage about zero volts may be sinusoidal, rectangular, or triangular. The waveform may be symmetric, or it may be adjusted to be non-symmetric about zero volts or to be non-symmetric in time during either the positive or negative polarity. These waveforms are easily obtained from commercial power supplies.

Another embodiment of the invention is for the protection of electrical conduit which transmits commercial power or communications signals. These communication cables sometimes use the outer metal covering to transmit power, reserving the interior of the conduit for information signals. Specifically, cables which transmit signals and power in the telephone loop plant use the outer metal covering of the cable to transmit power or to return it between the sending station and the subscriber premises. The use of an alternating square wave power source has been found beneficial to reduce corrosion of the outer aluminum covering.

Yet another embodiment of the method described above is for the protection of buried metallic structures, such as foundations, or pipelines which transport oil, gas, water, steam, or chemicals.

Still another embodiment of the application is the corrosion protection of amphoteric metals such as aluminum, tin, lead, zinc, or chromium. These metals have the property of acting like a base or an acid and can not be cathodically protected with a constant negative bias. The data above, however, show that an alternating voltage significantly raises the threshold voltage where corrosion begins and lowers the corrosion rate for a given applied voltage.

A further embodiment of the method is the corrosion protection of steel alloys which would otherwise be weakened by hydrogen embrittlement if they were made continuously cathodic. These alloys include very high strength steels, which are particularly prone to hydrogen embrittlement, and also ferritic and martensitic steels in sulfide environments, or any metal that has been severely cold worked.

Still another embodiment of the method is the protection of a metal that resides at a voltage above or below its surroundings. In this case, a constant voltage is applied of equal magnitude and of opposite polarity to that originally found on the metal, and an alternating voltage is then superimposed upon said opposite polarity.

The foregoing embodiments are performed by connecting the metal to be protected to one terminal of a source of alternating voltage and connecting a second terminal of the source to an electrode which is in contact with the surroundings of the metal, which are usually at ground potential. The metal's voltage will alternate about zero volts with an amplitude and frequency which are variable. Higher frequencies have been found to be more effective than lower frequencies to limit corrosion.

In a preferred embodiment, a communications cable, with an outer aluminum shield, designed to carry power to remote sites has been biased at 90 volts half wave alternating at one Hz with a square waveform to reduce corrosion.

Another preferred embodiment is to select a frequency of 60 Hz, which is easily derived from commercial power and which lowers the corrosion rate even further.

Changes and modifications in the specifically described embodiments can be carried out without departing from the scope of the invention. In particular, the frequency may be raised to any value above 60 Hz, for example, some military systems operate with 400 Hz power, so this frequency may also be used to prevent corrosion. At 1 MHz, there is insufficient time to charge the double layer, thus making the corrosion reaction unlikely.

We claim:

1. In a system containing a cable that is exposed to a corrosive environment, wherein said cable contains at least one conductive sheathing, a method of protecting said at least one conductive sheathing from corrosion, comprising the steps of:

providing a cable that is exposed to a corrosive environment, wherein said cable contains at least one conductive sheathing;

inducing a polarity in said at least one conductive sheathing: and alternating said polarity at a predetermined rate.

2. The method of claim 1 wherein said step of alternating said polarity includes applying an alternating voltage to said at least one conductive sheathing.

3. The method of claim 2 wherein said alternating voltage has a waveform selected from a group consisting of sinusoidal waves, rectangular waves, and triangular waves.

4. A method of protecting an amphoteric metal from corrosion, wherein said amphoteric metal is exposed to a corrosive environment, comprising the steps of:

providing an amphoteric metal exposed to a corrosive environment;

inducing a polarity in said amphoteric metal; and alternating said polarity at a predetermined rate.

5. The method of claim 4 wherein said step of alternating said polarity includes applying an alternating voltage to said amphoteric metal.

6. The method of claim 5 wherein said alternating voltage has a waveform selected from a group consisting of sinusoidal waves, rectangular waves, and triangular waves.

7. A method of protecting a steel alloy which is susceptible to hydrogen embrittlement from corrosion, wherein said steel alloy is exposed to a corrosive environment, comprising the steps of:

providing a steel alloy which is susceptible to hydrogen embrittlement and which is exposed to a corrosive environment;

inducing a polarity in said steel alloy; and alternating said polarity at a predetermined rate.

8. The method of claim 7 wherein said step of alternating said polarity includes applying an alternating voltage to said steel alloy.

9. The method of claim 8 wherein said alternating voltage has a waveform selected from a group consisting of sinusoidal waves, rectangular waves, and triangular waves.

10. The method of claim 7 wherein the waveform of the alternating voltage is a triangular wave.

11. A method of protecting a metal, wherein said metal has a residual voltage from exposure to an corrosive environment, said method comprising the steps of:

providing a metal having a residual voltage and which is exposed to a corrosive environment;

applying an opposite voltage to said metal to substantially eliminate said residual voltage; and applying an alternating voltage to the metal for varying the polarity associated with said metal with respect to the corrosive environment.

12. The method of claim 11 wherein said alternating voltage has a waveform selected from a group consisting of sinusoidal waves, rectangular waves, and triangular waves.

13. The method according to claim 1, wherein said predetermined rate is between 1 Hz and 60 Hz.

14. The method according to claim 1, wherein said predetermined rate is at least 60 Hz.

15. The method according to claim 1, wherein said at least one conductive sheathing includes an amphoteric metal.

16. The method according to claim 1, wherein said at least one conductive sheathing initially has a voltage difference with respect to said corrosive environment and said method further includes the steps of:

applying a voltage bias to said at least one conductive sheathing that opposes said voltage difference; and superimposing an alternating voltage on said at least one conductive sheathing.

17. The method according to claim 4, wherein said amphoteric metal is selected from a group consisting of aluminum, tin, and lead.

18. The method to claim 4, wherein said predetermined rate is between 1 Hz and 60 Hz.

19. The method according to claim 4, wherein said predetermined rate is at least 60 Hz.

20. The method according to claim 4, wherein said amphoteric metal initially has a voltage difference with respect to said corrosive environment and said method further includes the steps of:

applying a voltage bias to said amphoteric metal that reduces said voltage difference; and superimposing an alternating voltage on said amphoteric metal.

21. In an assembly having a conductive element exposed to a corrosive environment, wherein the onset of corrosion on said conductive element occurs above a threshold voltage, a method of retarding corrosion comprising the steps of:

providing a conductive element exposed to a corrosive environment, wherein the onset of corrosion on said conductive element occurs above a threshold voltage;

applying an alternating polarity to said conductive element; and increasing the frequency associated with said alternating polarity to a level wherein, said threshold voltage is increased by a predetermined percentage.

22. The method according to claim 21 wherein said predetermined percentage is at least 100%.

23. The method according to claim 21 wherein said conductive element includes aluminum and the frequency selected causes said threshold voltage to increase to at least 2.6 volts.

* * * * *